US006578329B1

(12) United States Patent
Stubler et al.

(10) Patent No.: US 6,578,329 B1
(45) Date of Patent: Jun. 17, 2003

(54) ANCHORING DEVICE FOR FIXING A STRUCTURAL CABLE TO A BUILDING ELEMENT

(75) Inventors: Jérôme Stubler, Paris (FR); Patrick Ladret, Montbrison (FR); Jean-Claude Percheron, Vienne Arthies (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/831,837

(22) PCT Filed: Sep. 12, 2000

(86) PCT No.: PCT/FR00/02512

§ 371 (c)(1),
(2), (4) Date: May 15, 2001

(87) PCT Pub. No.: WO01/20098

PCT Pub. Date: Mar. 22, 2001

(30) Foreign Application Priority Data

Sep. 15, 1999 (FR) ..... 99 11517

(51) Int. Cl.[7] ..... E04C 5/08

(52) U.S. Cl. ..... 52/223.14; 52/223.8; 52/223.13; 24/122.6; 29/452; 264/40.1; 403/367; 403/373; 403/374; 405/258; 405/259.5; 405/262

(58) Field of Search ..... 52/223.1, 223.14, 52/223.8, 223.13; 24/122.6, 136; 264/40.1, 228; 405/262, 258, 259.5, 259.6; 29/446, 452, 892.1; 403/367, 373, 374

(56) References Cited

U.S. PATENT DOCUMENTS 4,367,568 A * 1/1983 Weiser ..... 24/122.6
4,484,425 A * 11/1984 Muller ..... 52/223
4,594,827 A * 6/1986 Finsterwalder ..... 52/230
4,640,068 A * 2/1987 Jungwirth et al. ..... 52/223 L
4,671,034 A * 6/1987 Rehm et al. ..... 52/223 R
4,819,393 A * 4/1989 Augoyard ..... 52/223 L
4,848,052 A 7/1989 Nutzel
4,878,327 A 11/1989 Nutzel et al.
5,423,635 A * 6/1995 Keller et al. ..... 405/262
5,493,828 A * 2/1996 Rogowsky et al. ..... 52/223.13
6,318,038 B1 * 11/2001 Park ..... 52/223.13

FOREIGN PATENT DOCUMENTS

| | | |
|---|---|---|
| DE | 37 34954 | 7/1988 |
| DE | 3801 451 | 8/1989 |
| DE | 41 18 897 | 12/1992 |
| EP | 0 323 285 | 7/1989 |

* cited by examiner

*Primary Examiner*—Carl D. Friedman
*Assistant Examiner*—Yvonne M. Horton
(74) *Attorney, Agent, or Firm*—Cantor Colburn LLP

(57) ABSTRACT

An anchoring device for fixing a structural cable to a building element, the cable comprising a plurality of strands each comprising wires which are themselves enclosed together in a protective sheath, each of the protective sheaths being interrupted at a terminal edge such that the strands have each an exposed end section. The exposed section is inserted in a sealed chamber with a packing box whereof on plate is fixed and the other plate is compressed by threaded rods.

10 Claims, 2 Drawing Sheets

ANCHORING DEVICE FOR FIXING A STRUCTURAL CABLE TO A BUILDING ELEMENT

FIELD OF THE INVENTION

The present invention relates to anchoring devices for fixing structural cables to building elements.

In particular, the invention applies each time it is necessary to fix a cable, subjected to tensile loadings, to equip building elements such as cable-stayed bridges, suspension bridges or the like, by connecting the tops of the towers of these bridges to their decks and to their anchor blocks.

DESCRIPTION OF THE RELATED ART

The cables habitually encountered in such building elements comprise a number of strands each of which comprises metal wires themselves enveloped together in a protective sheath, each of these protective sheaths being interrupted at a terminal edge so that the strands each have a bared end portion.

The anchoring devices habitually encountered, particularly in EP-A-0 323 285, comprise:

- a perforated block in which the bared end portions of the various strands are individually anchored,
- a bearing surface which is secured to the building element and against which the periphery of the perforated block axially bears,
- a tube to which the perforated block is attached on the bearing surface side, the tube transversely delimiting a chamber inside which the terminal edges of the strands are located and which is filled with a substance that protects the bared end portions present in the chamber, and
- a packing box which seals the chamber, at the opposite end to the anchoring block, and which has the sheathed strands passing in a sealed manner through it, the packing box comprising:
  - at least two perforated plates of which one, known as the inner plate, is arranged on the same side as the chamber and of which the other, known as the outer plate, is arranged at the opposite end to the perforated block with respect to the inner plate, and
  - at least one piece of packing which is inserted between the inner plate and the outer plate.

In the known embodiments of the packing boxes encountered in the anchoring devices of the kind in question, the inner plate of the packing box is stationary while the outer plate can move and is driven toward the stationary plate by means of threaded rods passing through the perforated block and placed under tension. These rods are both screwed into the outer plate and into a nut butting against the perforated block.

To ensure good leaktightness of the anchoring device, it is possible for the packing of the packing box to be compressed again by exerting tension on the outer plate should that prove necessary. However, the ends of the threaded rods screwed into the outer plate are located on the same side as the cables and are therefore not accessible to the operator unless he dismantles the entire anchoring device.

An anchoring device such as this therefore involves significant and expensive maintenance operations because the mechanically stressed parts are located in places which are difficult to access.

SUMMARY OF THE INVENTION

It is an object of the present invention to overcome the aforementioned drawbacks by providing an anchoring device that makes maintenance operations easier.

To this end, according to the invention, an anchoring device of the kind in question is essentially characterized in that the outer plate is stationary with respect to the chamber and in that the device comprises means for pressing on the inner plate.

Thus, by virtue of these arrangements, all the constituent elements of the packing box are protected against corrosion and the elements which allow the packing to be compressed are accessible from the opposite side of the anchoring device to the side from which the cables extend, and therefore do not entail costly disassembly.

In some preferred embodiments of the anchoring device according to the present invention, recourse is further had to one and/or other of the following arrangements:

- the means for pressing on the inner plate comprise a compression rod, one end of which is in abutment against the inner plate and the other end of which passes through a hole made in the perforated block and which can be actuated from the opposite side of the perforated block to the bearing surface secured to the building element;
- the compression rod is a threaded rod and the hole is tapped, the rod being operable by screwing;
- the compression rod is in abutment against an insert plate fitted adjacent to the inner plate;
- the pressing means comprise a stop which is integral with the tube and which is situated inside the tube at a distance from the outer face of the outer plate that is more or less equal to the thickness of the packing box, and in which said at least one piece of packing is perforated with passages of a diameter smaller than the diameter of the sheathed strands;
- the packing box is placed in a groove formed inside the tube and the stop is defined by the step between the groove and the main part of the tube;
- the outer plate is in abutment against a stop sleeve attached to the end of the tube by screwing;
- the outer plate is in abutment against a perforated plate attached to the end of the tube;
- the protective substance is compressed in the chamber; and
- a cap is sealed onto the perforated block, delimiting a chamber into which the bared end portions of the strands project, the chamber being filled with said protective substance.

BRIEF DESCRIPTION OF THE INVENTION

Further features and advantages of the invention will become apparent in the course of the following detailed description of two of its embodiments which are given by way of nonlimiting examples with reference to the appended drawings in which.

DESCRIPTION OF PREFERRED EMBODIMENT

Figure 1:
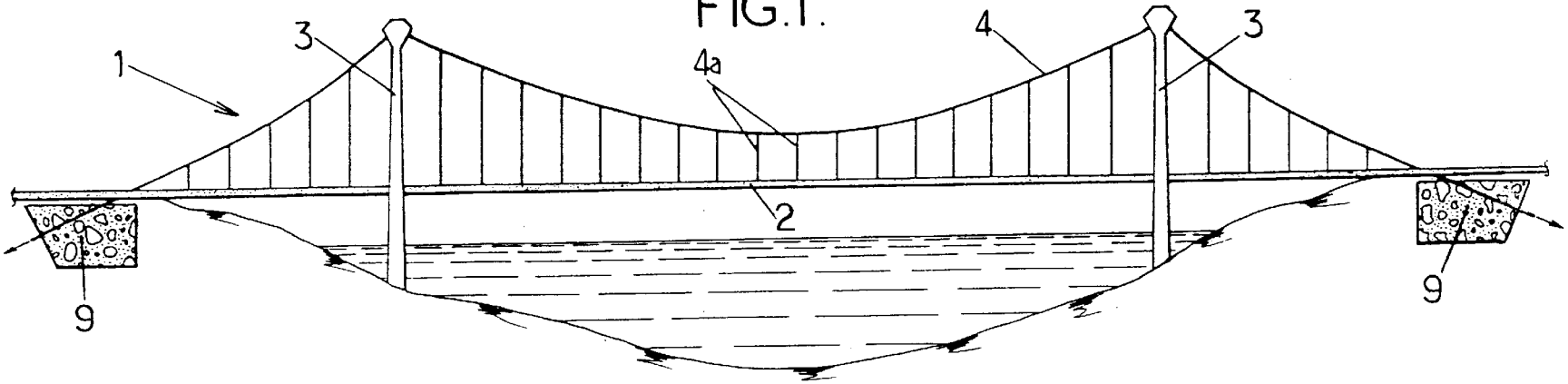
FIG. 1 is an overall schematic view of a suspension bridge, the cables of which are immobilized using anchoring devices according to the present invention.

The building element 1 depicted in FIG. 1 is, for example, a suspension bridge. This bridge conventionally has a deck 2, two posts or towers 3, two parallel suspension cables 4, just one being visible in the figure, and a number of hangers 4*a* which are attached to the cables 4 and which carry the deck 2.

The suspension cables 4 are stretched between two anchoring blocks 9 in the ground, located at the two ends of the bridge, and are supported by the two towers 3.

Figure 2:
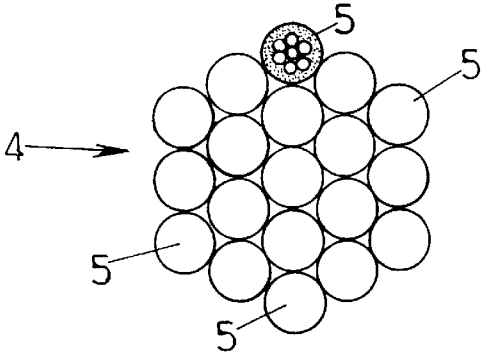
FIG. 2 is a view in cross section of a cable of FIG. 1.

As shown more particularly in FIG. 2, the cable 4 in question is made up of a number of individual strands 5.

Figure 3:
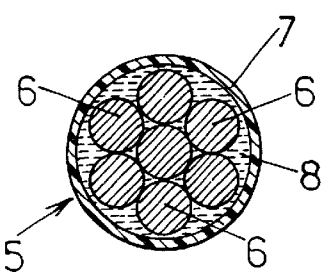
FIG. 3 is an enlarged sectional view of one of the strands that make up the cable of FIG. 2.

Each strand 5 is itself formed, as shown in FIG. 3, of a number of elemental wires 6, for example seven of these. These wires may be parallel or twisted and are made, for example, of galvanized steel. This collection of wires is surrounded by a protective sheath 7 capable of protecting them throughout their life against corrosion due to inclement weather or other external attack, particularly due to moisture and handling. This sheath is made, for example, of a plastic, such as polyethylene or a polyamide, or of a metal such as aluminum or stainless steel. The sheath is attached directly to the bundle of wires by extrusion.

The sheath in question may also be made of any other desirable coating of the bundle of wires 6, for example of an epoxy paint coated onto it.

The spaces between the wires 6 and sheath 7, if there are any, may or may not be filled with a protective substance 8 such as, for example, a resinous pitch of the epoxy type or a wax or polybutadiene.

The sheathed strands 5 thus defined, are all mutually identical, are autonomous, and remain so throughout the life of the cable 4 that they form.

Figure 4:
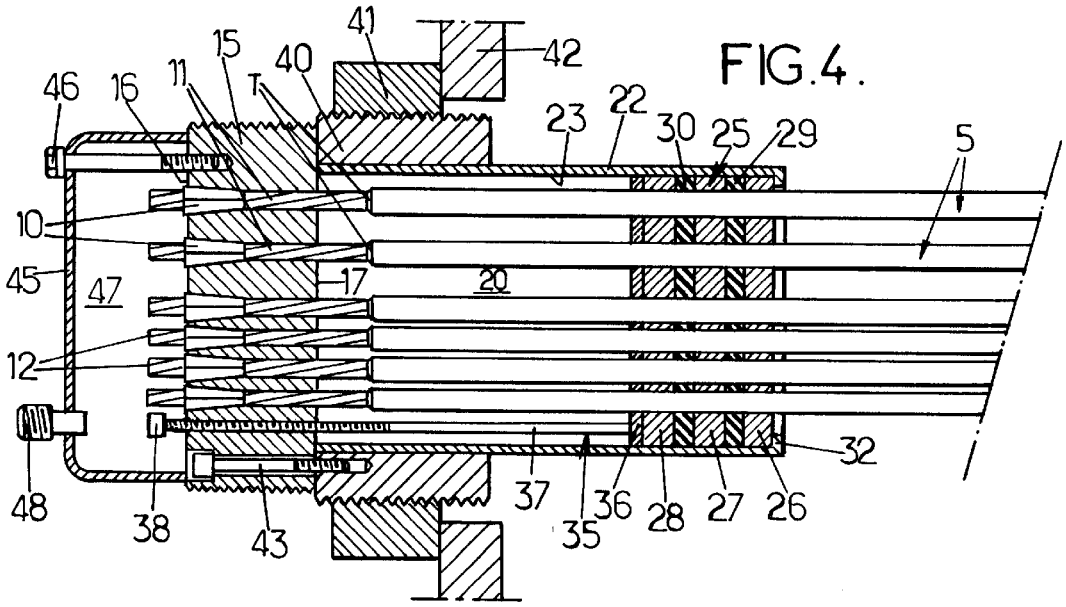
FIG. 4 is a view in longitudinal section of a first embodiment of the anchoring device for the cable of FIGS. 2 and 3.
Figure 5:
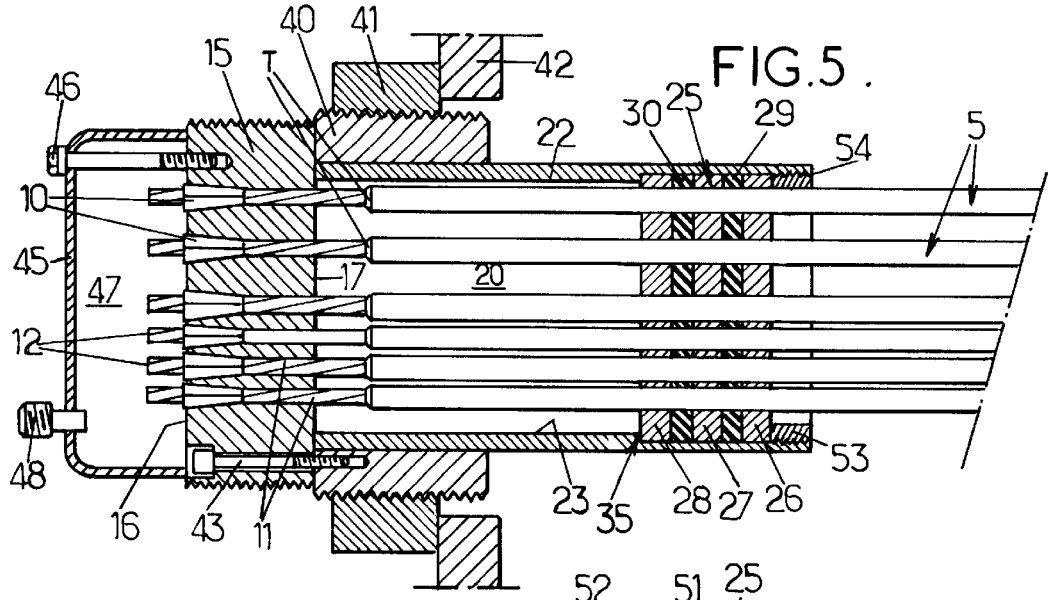
FIG. 5 is a view in longitudinal section of a second embodiment of the anchoring device for securing the cable of FIGS. 2 and 3.

The sheathed strands 5 of the cable 4 are tensioned individually, in a way known per se, on the bridge 1. For example, they are fitted using extruded sleeves or alternatively, as depicted in FIGS. 4 and 5, by clamping the ends of the strands 5 in split jaws 10.

For that, each of the protective sheaths 7 of the strands 5 is interrupted at a terminal edge T so that each strand 5 has a bared end portion 11.

The bared end portions 11 are clamped in the split jaws 10 each of which has, on the one hand, a tapped cylindrical hole capable of contiguously surrounding the end of the strand that is to be anchored and, on the other hand, a frustoconical external surface capable of collaborating with a complementary housing formed in a perforated anchoring block 15.

Each strand 5 is thus tensioned between, for example, a post 3 of the bridge 1 and the perforated block 15 secured, for example, to one of the anchoring blocks 9 for this bridge.

The perforated block 15 has two opposite faces: an outer face 16 and an inner face 17. The outer face 16 faces away from the strands 5. The ends 12 of the end portions 11 project from this face. The inner face 17 faces toward the strands 5.

In order to protect the end portions 11 of the strands 5 against corrosion, the terminal edges T of each of these strands are located inside a chamber 20 delimited:

at a first axial end, by the inner face 17 of the perforated block 15, transversely by a rigid tube 22 which is, for example, of cylindrical shape on a circular base and which is screwed or welded at one of its ends so as to be adjustable or stationary with respect to the inner face 17 of the perforated block 15;

and at the opposite axial end to the block 15, by a packing box 25 through which the sheathed strands 5 pass in a sealed way and which is pressed in a sealed way against the inner face 23 of the tube 22 under the effect of axial compression.

The packing box 25 consists, in a way known per se, of three perforated plates 26, 27 and 28, between which two pieces of packing 29 and 30, made: of an elastomeric material or the like, are inserted.

The perforated plates 26 to 28 are rigid plastic plates and all the plates and pieces of packing run transversely to the strands 5 so that the latter can pass through them. The plate 26 is an outer plate located at the end of the tube 22 facing toward the main length of cable, that is to say, toward the side from which the strands 5 run toward the tower 3. This plate is held in a stationary position with respect to the chamber 20 by being in abutment against a return 32 formed at the end of the tube 22.

The plates 26 to 28 hold the pieces of packing 29, 30 in compression to cause the edges of the pieces of packing to expand and produce the desired sealing. For this purpose, bearing means 35 collaborate with the plate 28 closest to the chamber 20, also known as the inner plate.

In the first embodiment depicted in FIG. 4, the bearing means 35 consist in an insert plate 36 which is perforated and pressed against the inner plate 28 and in threaded rods 37 (just one being depicted in FIG. 4). The threaded rods adopt the shape of screws each equipped with a head 38.

A first end of the threaded rod or screw 37 presses against the insert plate 36 while the second end of the rod 37 passes through a tapped hole 12 formed in the perforated block 15 so that the head 38 projects from the outer face 16 of this block. The threaded rod 37 can be operated by means of the head 38 to be screwed through the tapped hole.

The insert plate 36 is pushed back by the screwing of the threaded rods or screws 37. During this compression, the insert plate 36 moves the inner plate 28 closer to the outer plate 26 which itself remains stationary.

In order to immobilize the perforated block 15 with respect to the anchoring block 9, an adjusting tube 40 is mounted secured to the outer face of the tube 22, near the end of this tube adjacent to the perforated block 15 while a ring 41 is attached by screwing onto a complementary screw thread formed on the adjusting tube 40. This ring bears axially against an annular bearing surface 42 forming part of the anchoring block 9. The adjusting tube 40 is, for example, welded or screwed onto the tube 22 while the perforated block 15 is screwed onto the adjusting tube using screws 43 which are accessible from the outside face 16 of this block.

Furthermore, a cap 45 is sealed onto the outer face 16 of the perforated block 15 and is held thereon using screws 46. This cap delimits a chamber 47 in which the ends 12 of the bared end portions 11 of the strands 5 are situated, and which contains a flexible protective substance protecting these ends against corrosion.

The chamber 47 is filled with protective substance protecting against corrosion through an orifice which is then closed with a plug 48. The chamber 47 communicates with the chamber 20 via passages formed in the perforated block 15 (and which have not been depicted).

Once the strands 5 have been tensioned and once compression has been exerted on the insert plate 36 using the threaded rods or screws 37, the entirety of the two chambers 20 and 47 is filled with the substance that protects the bared portions of the strands 5 against corrosion.

By virtue of this arrangement, each strand S is autonomous throughout its length and may be tensioned or slackened independently of its neighbors. The ends 12 of these strands are readily accessible from the outer face 16 of the perforated block 15.

Likewise, the pieces of packing 29 and 30 may easily be recompressed periodically to maintain a good seal by screwing the heads 38 of the screws which are easily accessible from the outer face 16 of the block 15. The operator does not have to remove some of the constituent parts of the anchoring device described previously in order to access hidden parts.

Figure 6:
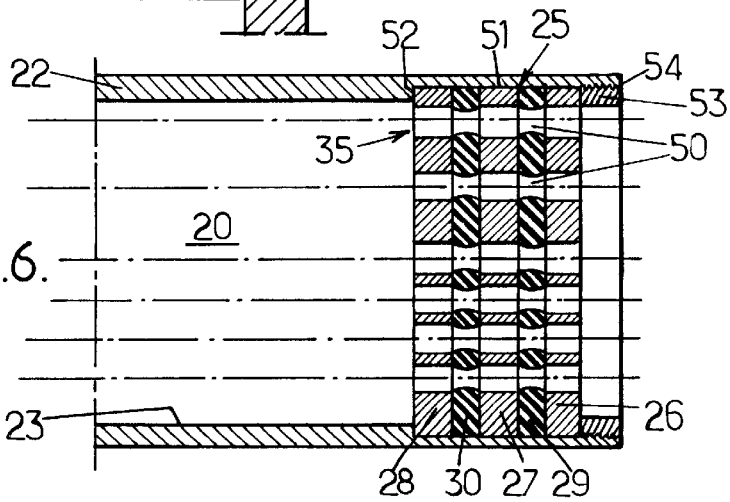
FIG. 6 is an enlarged sectional view of the packing box of the anchoring device of FIG. 5.

The second embodiment depicted in FIGS. 5 and 6 differs from the previous embodiment only in the form of the bearing means 35, the diameter of the passages formed in the pieces of packing 29 and 30, and the opposite end of the tube to the anchoring block.

The strands 5 are inserted in the pieces of packing 29 and 30 through passages 50 which have a diameter slightly smaller than that of the sheath 7 of the strands 5. In addition, a groove 51 is formed at the opposite end of the tube 22 to the anchoring block 15. The tube 22 thus has, at its end, a portion of inside diameter greater than the inside diameter of the rest of the tube. A step 52 is defined by this change in diameter. The three perforated plates 26 to 28 and the pieces of packing 29 and 30 are inserted in this groove 51 via the end of the tube 22. The plates and the pieces of packing are in abutment against the step 52 and are kept in compression against one another by means of a stop sleeve 53. This sleeve is attached to the end of the tube 22 and held in place by means of a screw thread 54 which collaborates with a tapping formed inside the end portion of the tube.

As an alternative, a perforated plate replaces the stop sleeve and is screwed onto the end of the tube 22. This plate contains as many perforations as there are strands to be inserted into the packing box.

When the strands 5 are inserted in the packing box, the additional material of the pieces of packing 29 and 30, due to the smaller diameter of the passages 50 is compressed against the groove 51, providing a very good seal.

Sealing is further improved when inserts are attached and inserted in the packing box in such a way that the material of the pieces of packing in even more pushed back. To this end, the perforated plate has a greater number of perforations than there are strands.

In yet another alternative form, the substance in the chamber 20 is compressed in such a way that the inner plate 25 of the packing box is pushed back toward the outer plate which itself remains stationary. The pieces of packing 29, 30 are thus compressed more strongly, enhancing the sealing.

What is claimed is:

1. Anchoring device for securing a structural cable to a building element, said cable comprising a number of strands each of which comprises metal wires themselves enveloped together in a protective sheath, each of the protective sheaths being interrupted at a terminal edge so that the strands each has a bared end portion, the anchoring device comprising:

a perforated block in which the bared end portions of the various strands are individually anchored;

a bearing surface which is secured to the building element and against which the periphery of the perforated block axially bears;

a tube to which the perforated block is attached on the bearing surface side, the tube transversely delimiting a chamber inside which the terminal edges of the strands are located and which is filled with a substance that protects the bared end portions present in the chamber;

a packing box which seals the chamber, at the opposite end to the perforated block, and which has the strands passing in a scaled manner through it, the packing box comprising:

at least two perforated plates of which one, known as an inner plate, is arranged on the same side as the chamber and of which the other, known as an outer plate, is arranged at the opposite end to the packing box with respect to the inner plate; and at least one piece of packing which is inserted between the inner plate and the outer plate, the outer plate being stationary with respect to the chamber; and pressing means for pressing on the inner plate.

2. Anchoring device according to claim 1, wherein the pressing means for pressing on the inner plate comprises a compression rod, one end of which is in abutment against the inner plate and the other end of which passes through a hole made in the perforated block and which is adapted for being actuated from the opposite side of the perforated block to the bearing surface secured to the building element.

3. Anchoring device according to claim 2, wherein the compression rod is a threaded rod and the hole is tapped, the rod being operable by screwing.

4. Anchoring device according to claim 2, wherein the compression rod is in abutment against an insert plate fitted adjacent to the inner plate.

5. Anchoring device according to claim 1, wherein the pressing means comprises a stop which is integral with the tube and which is situated inside the tube at a distance from the outer face of the outer plate that is approximately equal to a thickness of the packing box, and in which said at least one piece of packing is perforated with passages of a diameter smaller than a diameter of the strands.

6. Anchoring device according to claim 5, wherein the packing box is placed in a groove formed inside the tube and the stop is defined by a step between the groove and a main part of the tube.

7. Anchoring device according to claim 1, where the outer plate is in abutment against a stop sleeve attached to the end of the tube by screwing.

8. Anchoring device according to claim 1, wherein the outer plate is in abutment against a perforated plate attached to the end of the tube.

9. Anchoring device according to claim 5, wherein the protective substance is compressed in the chamber.

10. Anchoring device according to claim 1, wherein a cap is scaled onto the perforated block, delimiting a chamber into which the bared end portions of the strands project, the chamber being filled with said protective substance.

* * * * *